US012800217B2

(12) United States Patent
Capoj et al.

(10) Patent No.: US 12,800,217 B2
(45) Date of Patent: Nov. 17, 2026

(54) SMART FREEZING APPLIANCE WITH DEFROSTING COMPARTMENT

(71) Applicant: Charter Communications Operating, LLC, St. Louis, MO (US)

(72) Inventors: Daniela Capoj, Englewood, CO (US); Ryan William Loaiza, Brighton, CO (US); Taren Geddes McCullough, Plymouth, MN (US)

(73) Assignee: Charter Communications Operating, LLC, St. Louis, MO (US)

( * ) Notice: Subject to any disclaimer, the term of this patent is extended or adjusted under 35 U.S.C. 154(b) by 122 days.

(21) Appl. No.: 18/936,435

(22) Filed: Nov. 4, 2024

(65) Prior Publication Data

US 2026/0126236 A1 May 7, 2026

(51) Int. Cl.
*F25D 21/00* (2006.01)
*F25D 25/04* (2006.01)

(52) U.S. Cl.
CPC ..... *F25D 21/006* (2013.01); *F25D 25/04* (2013.01)

(58) Field of Classification Search
CPC ..... F25D 21/006; F25D 25/04
See application file for complete search history.

(56) References Cited

U.S. PATENT DOCUMENTS

2019/0191500 A1* 6/2019 Mongin et al. ..... F25D 23/12

FOREIGN PATENT DOCUMENTS

CN 110810699 A * 2/2020 ..... F25D 23/12
GB 2209332 A * 5/1989 ..... G07F 9/105
JP WO 2011135865 A1 * 11/2011 ..... F25D 11/02

OTHER PUBLICATIONS

CN 110810699 A Translation (Year: 2020).*
GB 2209332 A Translation (Year: 1989).*
WO 2011135865 A1 (Year: 2011).*

* cited by examiner

*Primary Examiner* — Jerry-Daryl Fletcher
*Assistant Examiner* — Dario Antonio Deleon
(74) *Attorney, Agent, or Firm* — Mendelsohn Dunleavy, P.C.; Steve Mendelsohn

(57) ABSTRACT

A smart appliance having a wireless radio that receives a defrosting command from a remote wireless controller, a local controller that receives the defrosting command from the wireless radio, and a freezer section that stores a frozen item. Upon receipt of the defrosting command, the local controller is adapted to control the freezer section to thaw the frozen item, for example, using air warmed by heat from the appliance's cooling system. In some embodiments, the smart appliance moves the frozen item from the freezer section into a defrosting section that receives the warmed air. In other embodiments, the warmed air flows into the freezer section to thaw the frozen item without moving the item.

20 Claims, 17 Drawing Sheets

600

CHEST FREEZER/SIDE VIEW
A–A

700

SMART FREEZING APPLIANCE WITH DEFROSTING COMPARTMENT

BACKGROUND

Field of the Disclosure

The present disclosure relates to smart appliances such as smart freezers and smart refrigerators having freezer sections.

Description of the Related Art

This section introduces aspects that may help facilitate a better understanding of the disclosure. Accordingly, the statements of this section are to be read in this light and are not to be understood as admissions about what is prior art or what is not prior art.

Many frozen foods stored in a home freezer or the freezer section of a home refrigerator need to be defrosted before they are cooked and/or eaten. Such defrosting is typically accomplished by the consumer manually moving the frozen item from the appliance to a location where the frozen item will defrost over time, such as into the refrigerator section, onto a countertop, or into a microwave oven having a defrost function. All of these manual options involve the consumer being present in the home, which can result in delays in cooking and/or eating the food.

SUMMARY

Problems in the prior art are addressed in accordance with the principles of the present disclosure by a smart appliance, such as a smart standalone freezer or a smart refrigerator having a freezer section, that can be remotely controlled to defrost a frozen item stored within the appliance.

BRIEF DESCRIPTION OF THE DRAWINGS

Embodiments of the disclosure will become more fully apparent from the following detailed description, the appended claims, and the accompanying drawings in which like reference numerals identify similar or identical elements.

FIGS. 2A and 2B respectively show schematic front and back X-ray views of a smart appliance according to certain embodiments of the disclosure, while

FIGS. 5A and 5B respectively show schematic front and back X-ray views of a smart appliance according to certain other embodiments of the disclosure, while

FIG. 6A is a schematic front X-ray view of a smart appliance according to certain embodiments of the disclosure, while

FIGS. 7A and 7B respectively show schematic front and back X-ray views of a smart appliance according to certain embodiments of the disclosure, while

As used herein, the term "X-ray" implies that the corresponding figure shows internal features that would not be visible from an exterior view or a single cross-sectional view.

DETAILED DESCRIPTION

Detailed illustrative embodiments of the present disclosure are disclosed herein. However, specific structural and functional details disclosed herein are merely representative for purposes of describing example embodiments of the present disclosure. The present disclosure may be embodied in many alternate forms and should not be construed as limited to only the embodiments set forth herein. Further, the terminology used herein is for the purpose of describing particular embodiments only and is not intended to be limiting of example embodiments of the disclosure.

As used herein, the singular forms "a," "an," and "the," are intended to include the plural forms as well, unless the context clearly indicates otherwise. It further will be understood that the terms "comprises," "comprising," "contains," "containing," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functions/acts involved.

Figure 1:
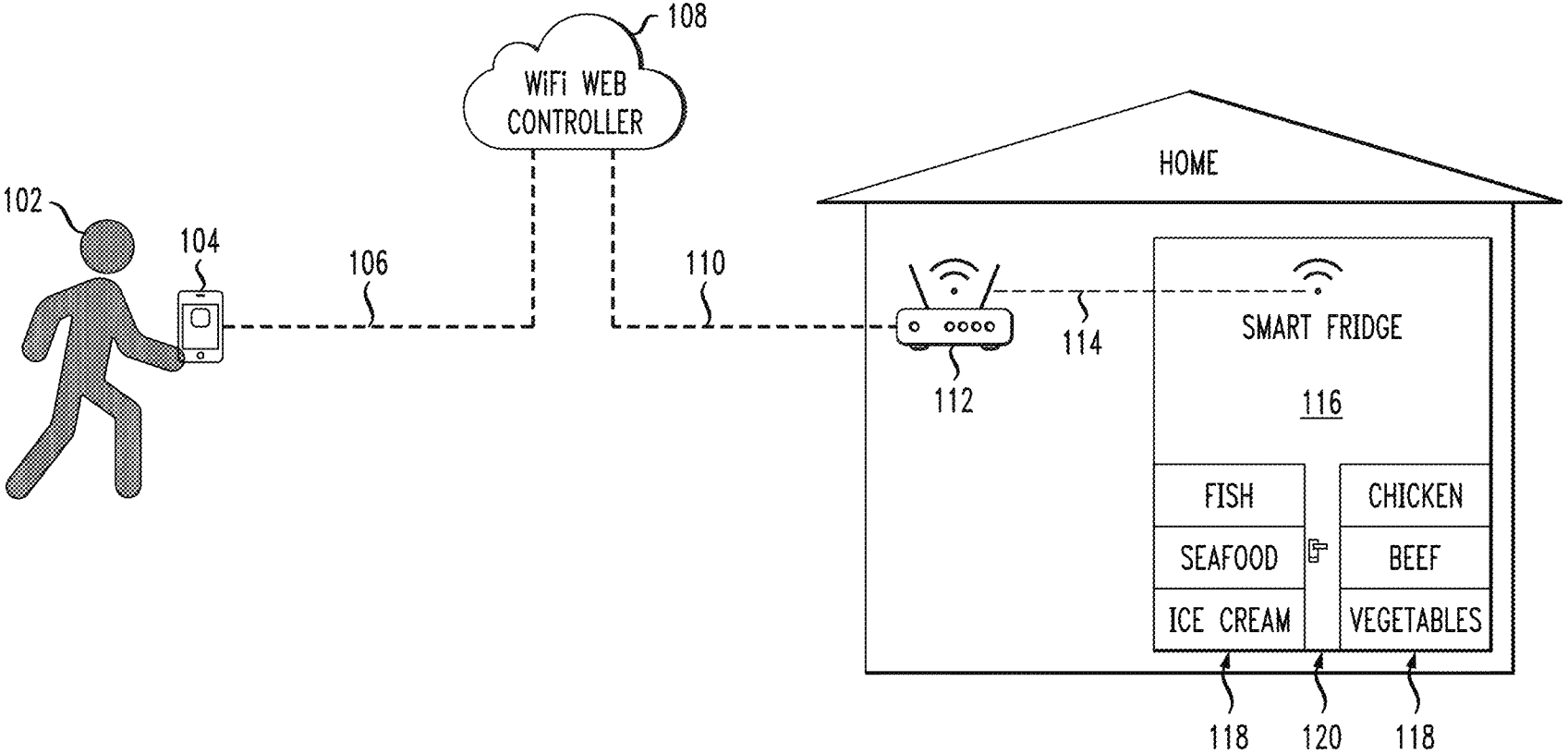
FIG. 1 is a schematic diagram illustrating one possible implementation of the present disclosure.

FIG. 1 is a schematic diagram illustrating one possible implementation of the present disclosure. As shown in FIG. 1, a consumer (aka user) 102 uses an app running on their wireless device (in this case, a smartphone) 104 to access, via a cellular network 106, a web-based WiFi controller 108 that can communicate (110) with the consumer's home WiFi router (aka access point) 112 to wirelessly control (114) a smart appliance (in this case, a refrigerator) 116 of the present disclosure to move a frozen item (not shown in FIG. 1) from a freezer section 118 of the smart appliance 116 into a defrosting section 120 of the smart appliance 116, where the frozen item will thaw for subsequent cooking and/or eating. In this way, the smart appliance 116 functions as an Internet of Things (IoT) device connected to the home router 112 and controlled, via the web controller 108, by smart appliance app running on the smartphone 104.

Figure 2A:
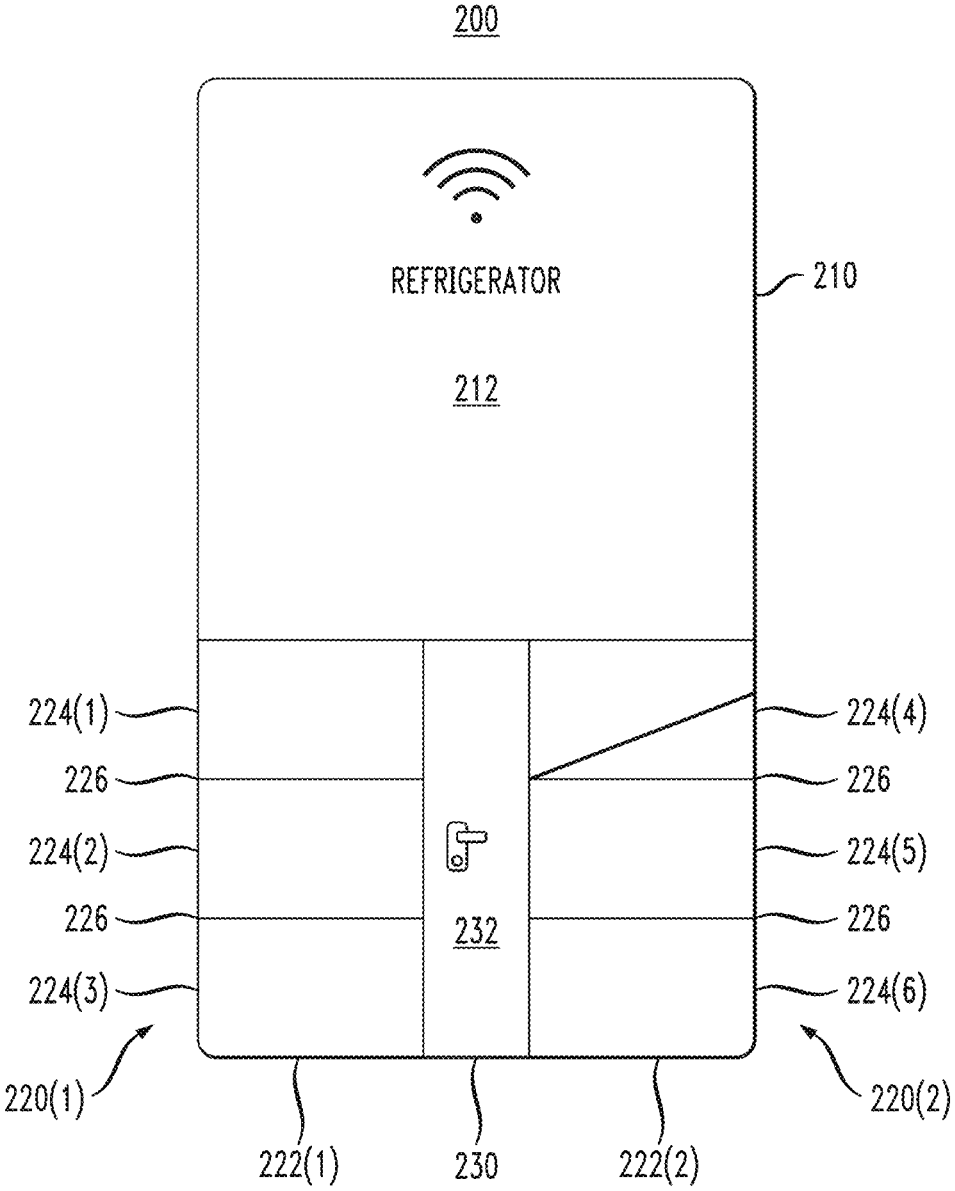
Figure 2B:
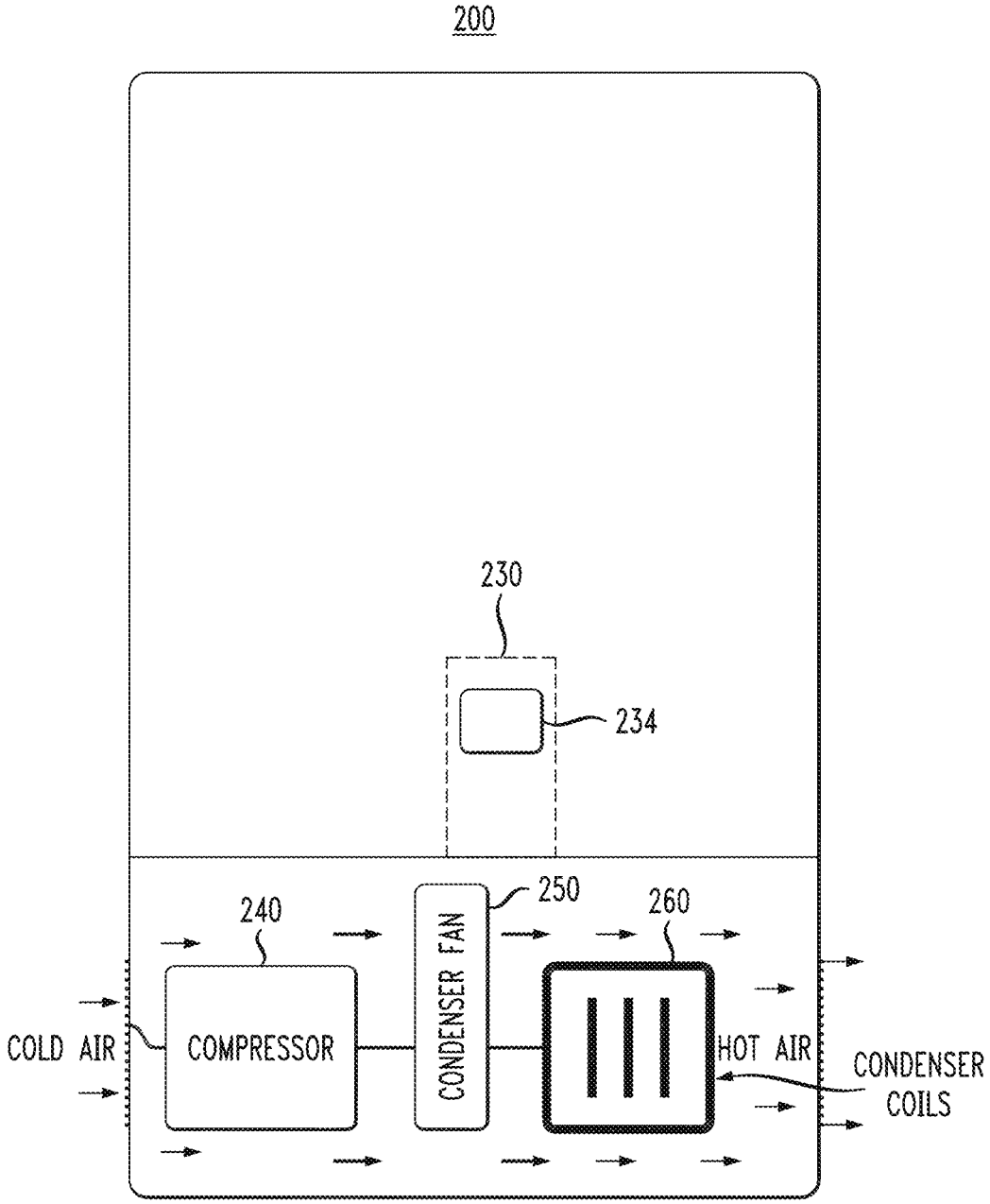
Figure 2C:
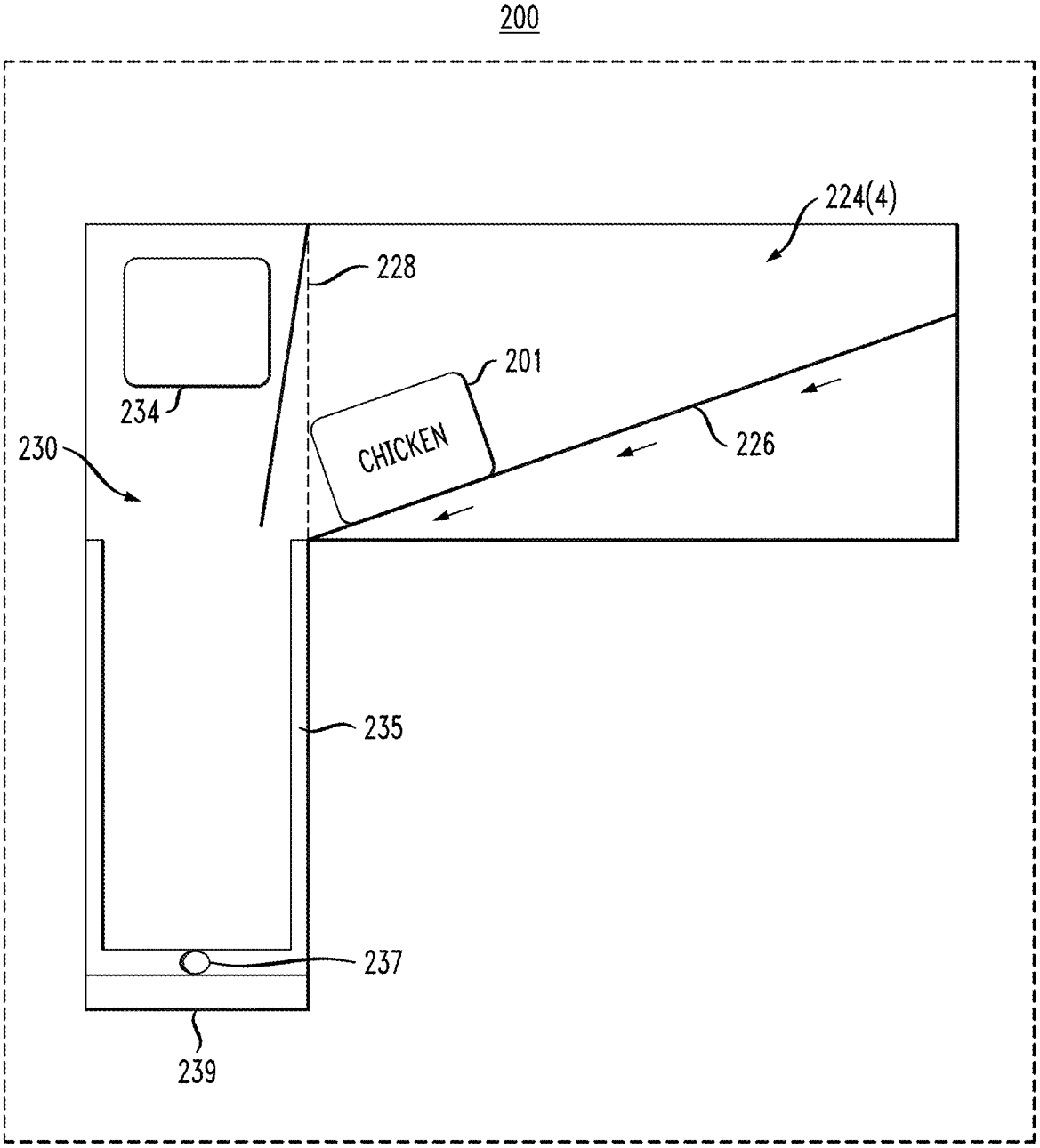
FIG. 2C shows a schematic front X-ray view of a portion of the smart appliance of FIGS. 2A and 2B.

FIGS. 2A and 2B respectively show schematic front and back X-ray views of a smart appliance 200 according to certain embodiments of the disclosure, while FIG. 2C shows a schematic front X-ray view of a portion of the smart appliance 200 of FIGS. 2A and 2B.

As shown in FIG. 2A, the smart appliance 200 has an (upper) refrigerator section 210 having a refrigerator door 212, a (lower) left freezer section 220(1) having a left freezer door 222(1), a (lower) right freezer section 220(2) having a right freezer door 222(2), and a (lower) defrosting section 230 located between the two freezer sections 220(1) and 220(2) and having a defrosting door 232. The left freezer section 220(1) has three shelves 224(1)-224(3) for storing frozen items (not shown in FIG. 2A) and the right freezer section 220(2) has three more shelves 224(4)-224(6) for storing more frozen items (not shown in FIG. 2A). In some implementations, the shelves 224 are separated vertically by adjustable spacers 226 to accommodate frozen items of different sizes.

As shown in FIG. 2B, the smart appliance 200 has a conventional cooling system that includes a compressor 240, a condenser fan 250, and condenser coils 260, where the cooling system maintains the low temperatures inside the smart appliance's refrigerator and freezer sections 210 and 220. As understood by those skilled in the art, the condenser fan 250 pulls ambient air across the compressor 240 and blows that ambient air across the condenser coils 260 to transfer heat from both the compressor 240 and the condenser coils 260 to that ambient air.

Unlike a conventional refrigerator or freezer, which vents the cooling system's resulting warmed air back into the room, in at least some embodiments of smart appliances of the disclosure, at least some of the warmed air will flow into the smart appliance's defrosting section 230, as indicated in FIG. 2C. As shown in FIG. 2B, in some implementations, the back of the smart appliance 200 has a respiratory window 234 (e.g., with an air filter) that enables ambient air and/or warmed air from the smart appliance's cooling system to flow into the defrosting section 230.

FIG. 2C shows a representation of shelf 224(4) of the smart appliance 200. Shelf 224(4) has an angled ramp 226 supporting, in this case, a particular frozen item 201. Separating shelf 224(4) and the defrosting section 230 is an electromechanical door 228 that thermally isolates the defrosting section 230 from the corresponding shelf space and can be remotely controlled by the user 102 of FIG. 1 using their smartphone 104. When the door 228 is remotely controlled to open, the frozen item 201 will slide down the ramp 226 and into the bottom of the defrosting section 230 due to gravity and the low coefficient of friction between the frozen item 201 and the top surface of the ramp 226. The door 228 will then automatically close based, for example, on a programmable timer expiring or one or more (optical, weight, and/or ultrasonic) sensors that detect the frozen item 201 leaving the shelf 224(4) and/or entering the defrosting section 230. With the defrosting section 230 receiving warmed air from the smart appliance's cooling system, the frozen item 201 will then begin to thaw.

As shown in FIG. 2C, the walls 235 of the defrosting section 230 may be made of a metal having a high heat conductance to enhance the thawing process. In addition, the defrosting section 230 may have a drain hole 237 and a collection pan 239 to collect liquid (e.g., water) resulting from the thawing process. In addition, the defrosting section 230 may have a temperature sensor (not shown) that can measure and report the temperature inside the defrosting section 230 to the user's remote smartphone 104.

Figure 3:
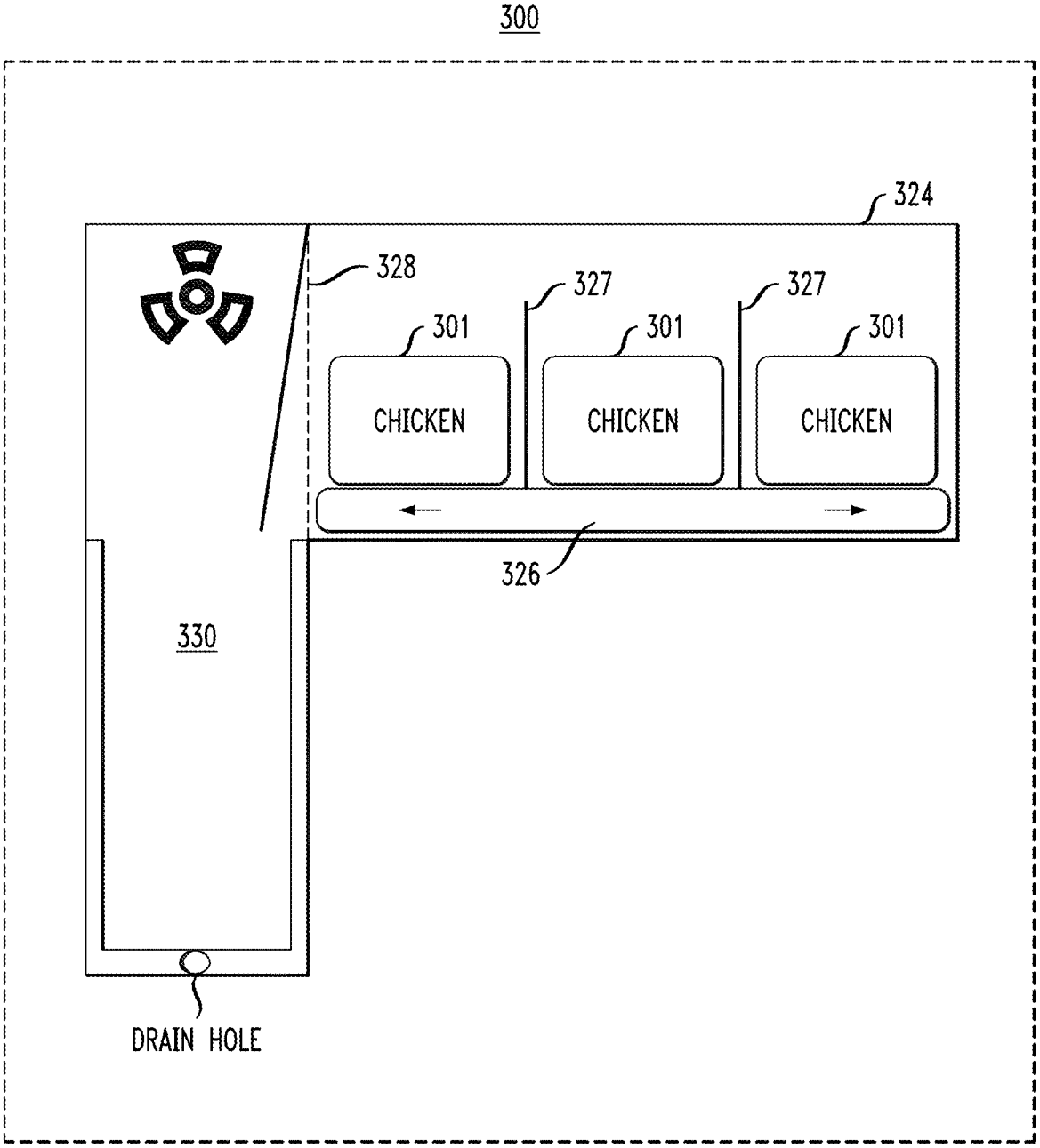
FIG. 3 is a schematic front X-ray view of a portion of a shelf of an alternative smart appliance of the disclosure.

FIG. 3 is a schematic front X-ray view of a portion of a shelf 324 of an alternative smart appliance 300 of the disclosure. Here, instead of the shelf having an angled ramp, as in shelf 224(4) of FIG. 2C, the shelf 324 has a conveyor belt 326 that moves frozen items 301 one at a time from the shelf 324 into the defrosting section 330. In this case, the door 328 can be, but does not have to be, a remotely controllable electromechanical device. Alternatively, the door 328 may have a magnetic latch (not shown) that allows the door 328 to open in response to the force from the frozen item 301 being moved by the conveyor belt 326, while the magnetic latch keeps the door 328 closed at other times.

As shown in FIG. 3, the shelf 324 may have spacers 327 that separate the frozen items 301 on the shelf 324. In some implementations, the spacers 327 fall into the defrosting section 330 along with the frozen items 301 to be manually replaced on the shelf 324 when the shelf is reloaded with new frozen items.

Figure 4:
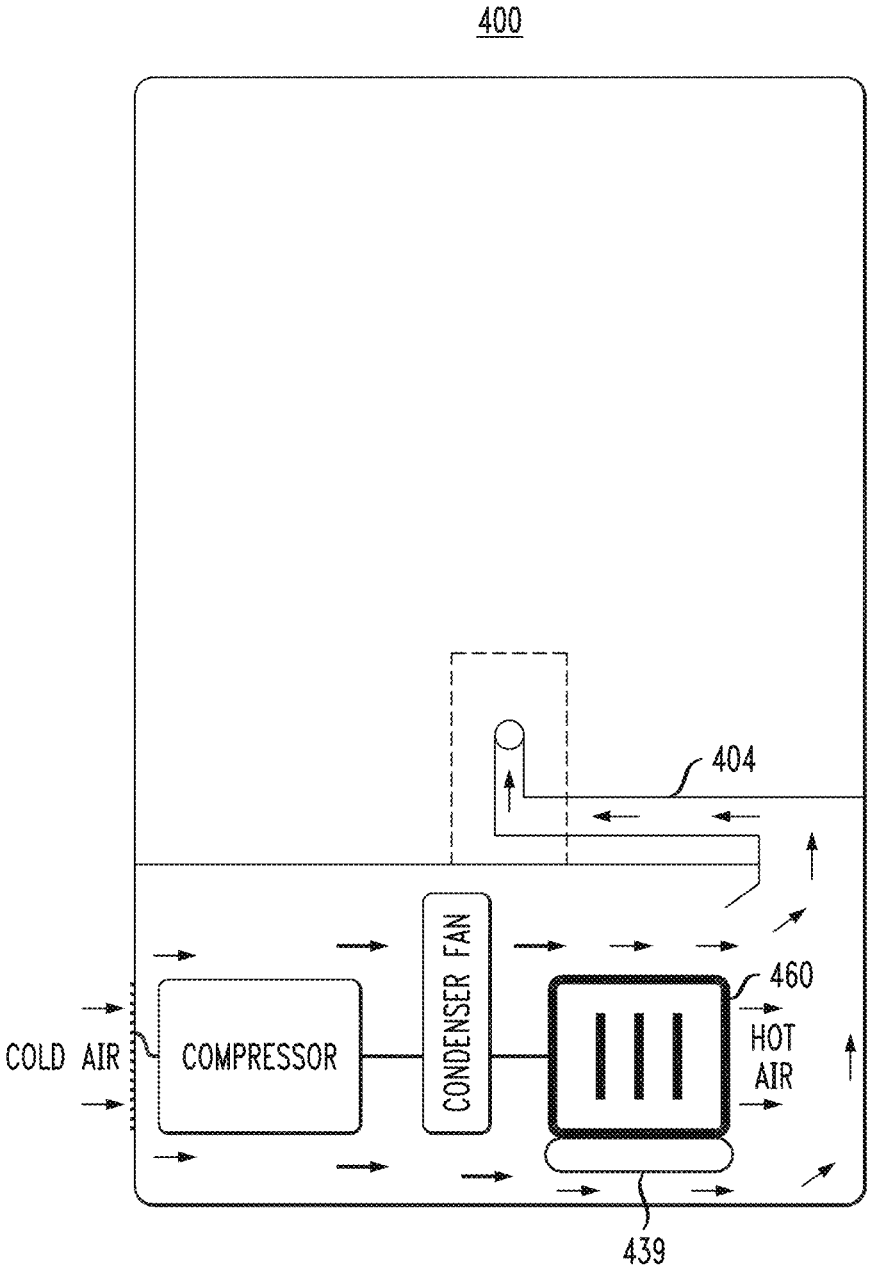
FIG. 4 is a schematic back X-ray view of another alternative smart appliance of the disclosure.

FIG. 4 is a schematic back X-ray view of another alternative smart appliance 400 of the disclosure. Here, the smart appliance 400 has suitable internal ductwork 404 that directs some of the warmed air from the smart appliance's cooling system into the smart appliance's defrosting section. In some implementations, fans and/or valves (not shown) that are part of the smart appliance's ductwork CU are controllable such that warmed air will flow into the smart appliance's defrosting section from the smart appliance's cooling system only when controlled to do so, such as when there is a frozen item in the defrosting section to be thawed. In some implementations, the collection pan 439 is located under the condenser coils 460 such that any liquids resulting from the thawing process that are collected in the collection pan 439 will be evaporated by heat from the condenser coils 460, thereby avoiding the need to manually drain the collection pan 439.

Figure 5A:
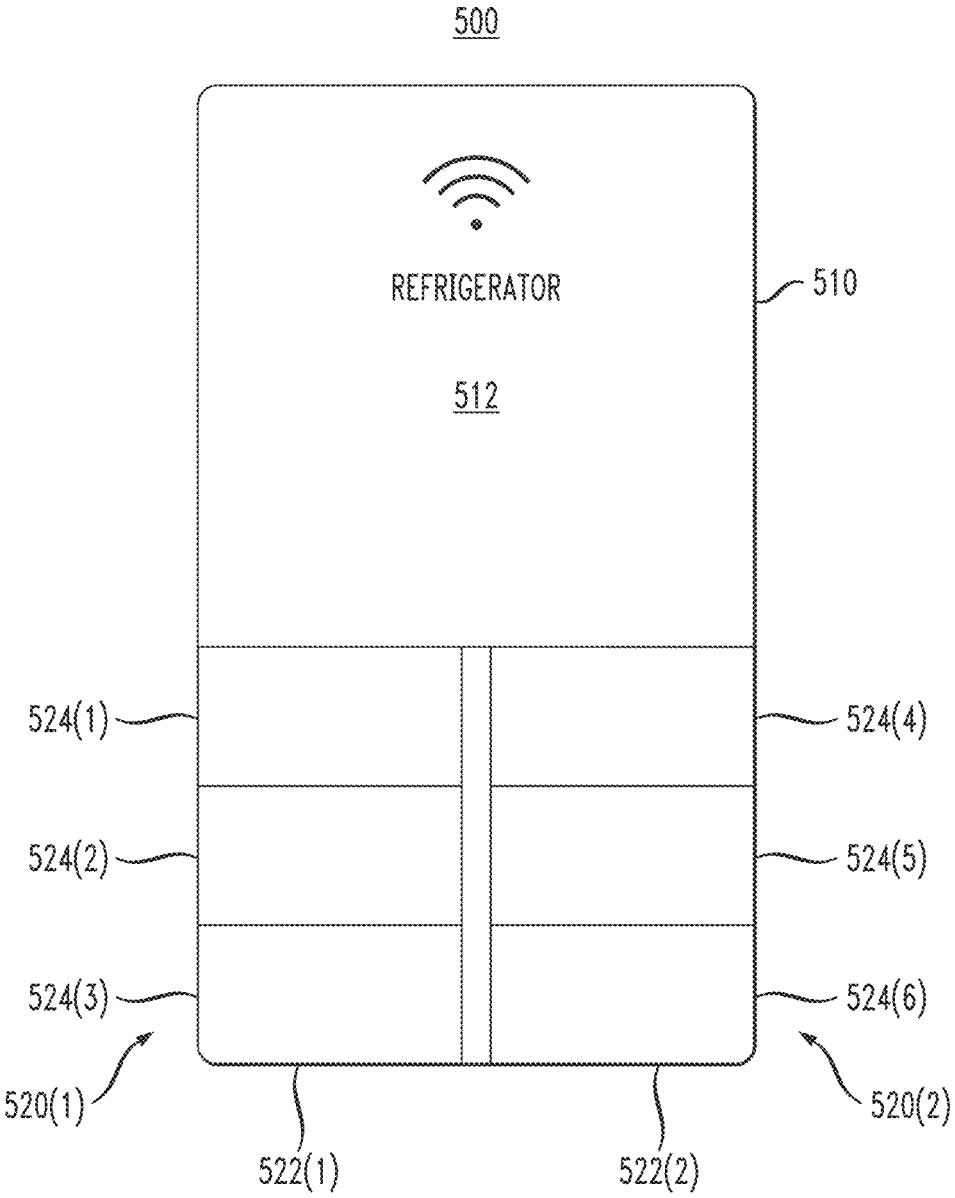
Figure 5B:
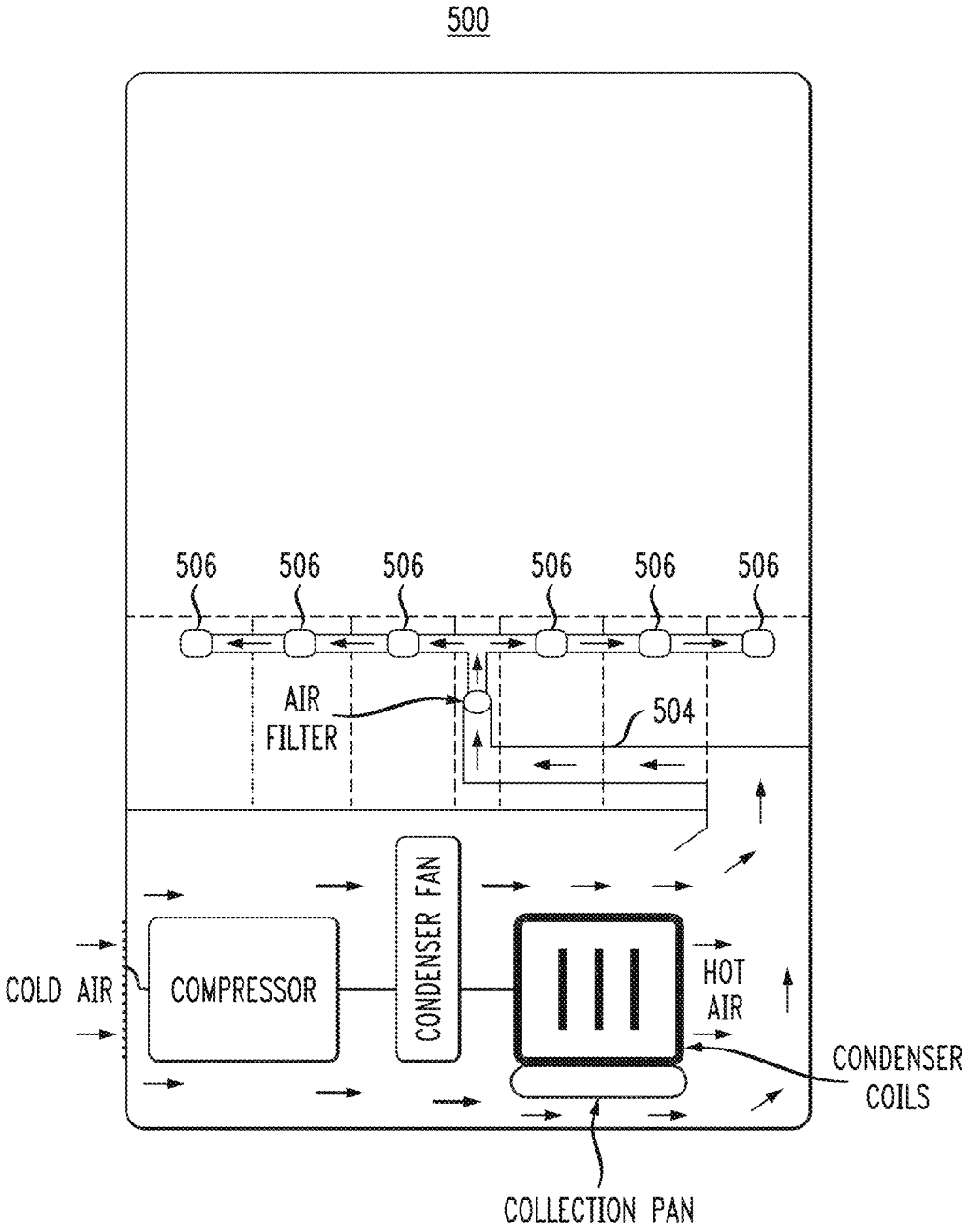
Figure 5C:
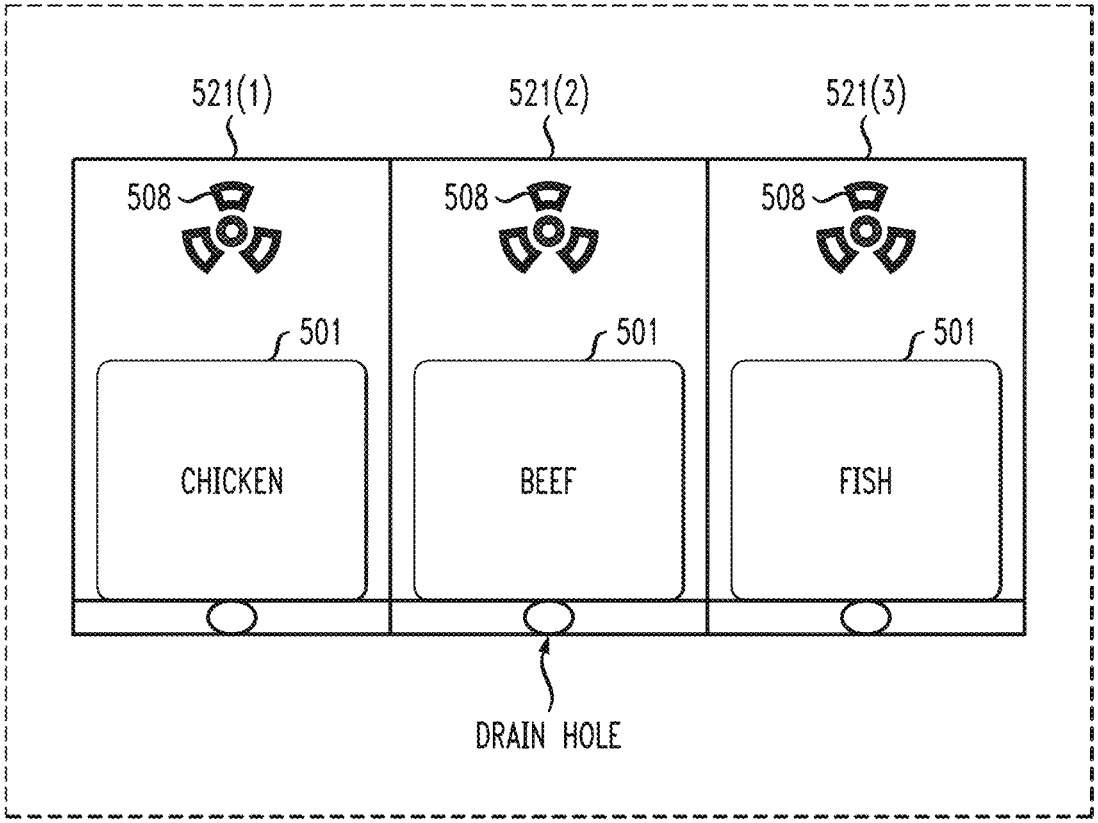
FIG. 5C shows a schematic front X-ray view of a portion of the smart appliance of FIGS. 5A and 5B.

FIGS. 5A and 5B respectively show schematic front and back X-ray views of a smart appliance 500 according to certain other embodiments of the disclosure, while FIG. 5C shows a schematic front X-ray view of a portion of the smart appliance 500 of FIGS. 5A and 5B. Instead of physically moving frozen items from a freezer section to a different, defrosting section, as in the embodiments of FIGS. 1-4, these embodiments have combined freezing/defrosting sections having dual-function shelves that can selectively and independently function as either freezer space to keep items frozen or defrosting space to thaw frozen items.

In particular, as shown in FIG. 5A, the smart appliance 500 has an (upper) refrigerator section 510 having a refrigerator door 512, a (lower) left combined freezing/defrosting section 520(1) having a left door 522(1), and a (lower) right combined freezing/defrosting section 520(2) having a right door 522(2). The left combined section 520(1) has three dual-function shelves 524(1)-524(3) and the right combined section 520(2) has three more dual-function shelves 524(4)-524(6).

FIG. 5C shows a representation of dual-function shelf 524(4) of the smart appliance 500. As shown in FIG. 5C, dual-function shelf 524(4) has three different compartments 521(1)-521(3), each of which can store one or more different frozen items 501.

As shown in FIG. 5B, the smart appliance 500 has ductwork 504 having remotely and independently controllable warm-air valves 506 that enable each compartment 521 of each dual-function shelf 524 to function as either normal freezer space (by closing a corresponding warm-air valve 506) or as a defrosting space (by opening the corresponding warm-air valve 506 to allow warmed air to thaw the corresponding frozen item(s) 501). As shown in FIG. 5C, each compartment 521 may have a remotely controllable fan 508 to assist in the moving of warmed air into the corresponding compartment 521. Note that the smart appliance 500 may also have respective remotely controllable cold-air valves (not shown) that independently and selectively allow cold air from the smart fridge's cooling system to flow into the corresponding dual function shelves 524.

Figure 6A:
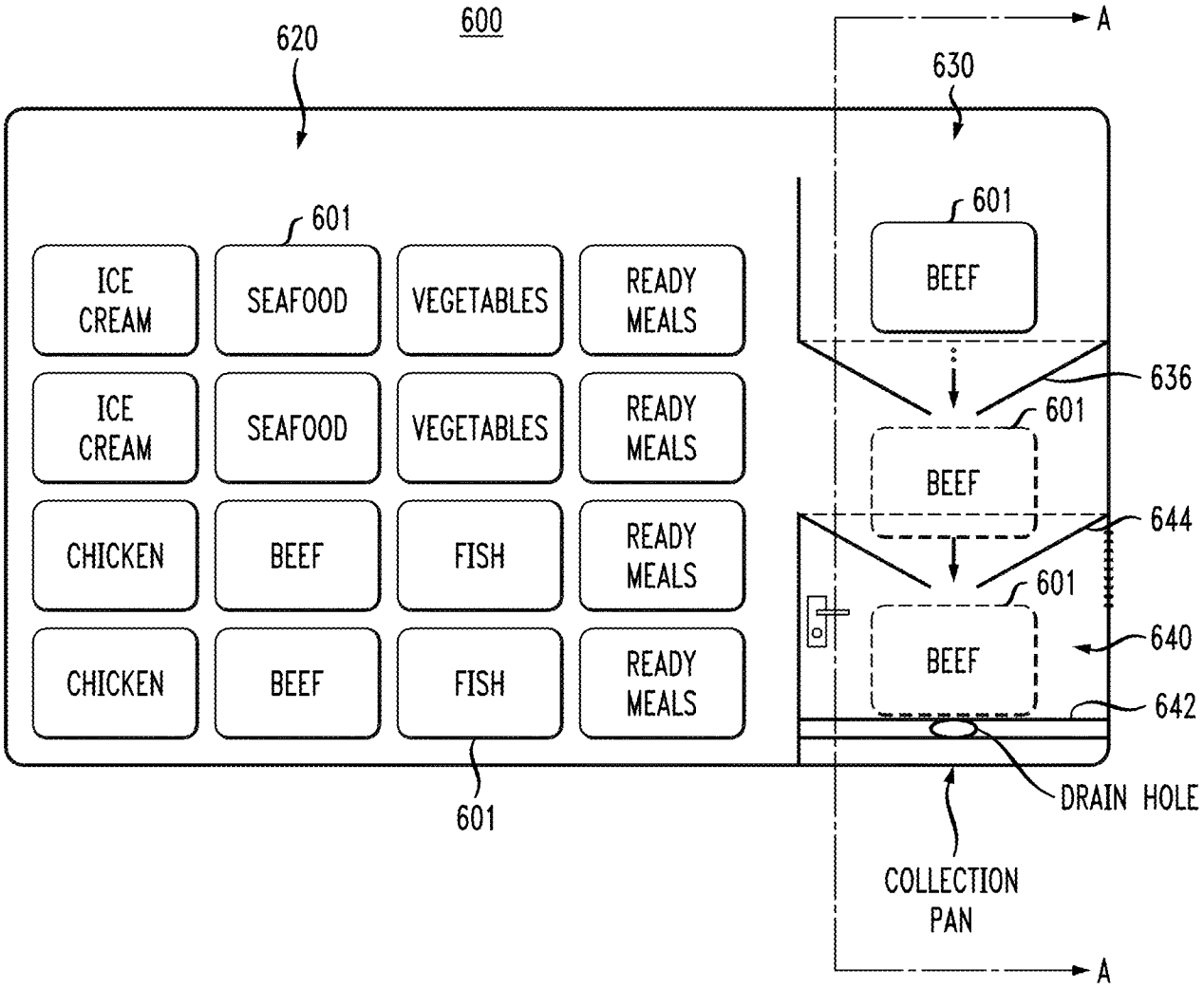
Figure 6B:
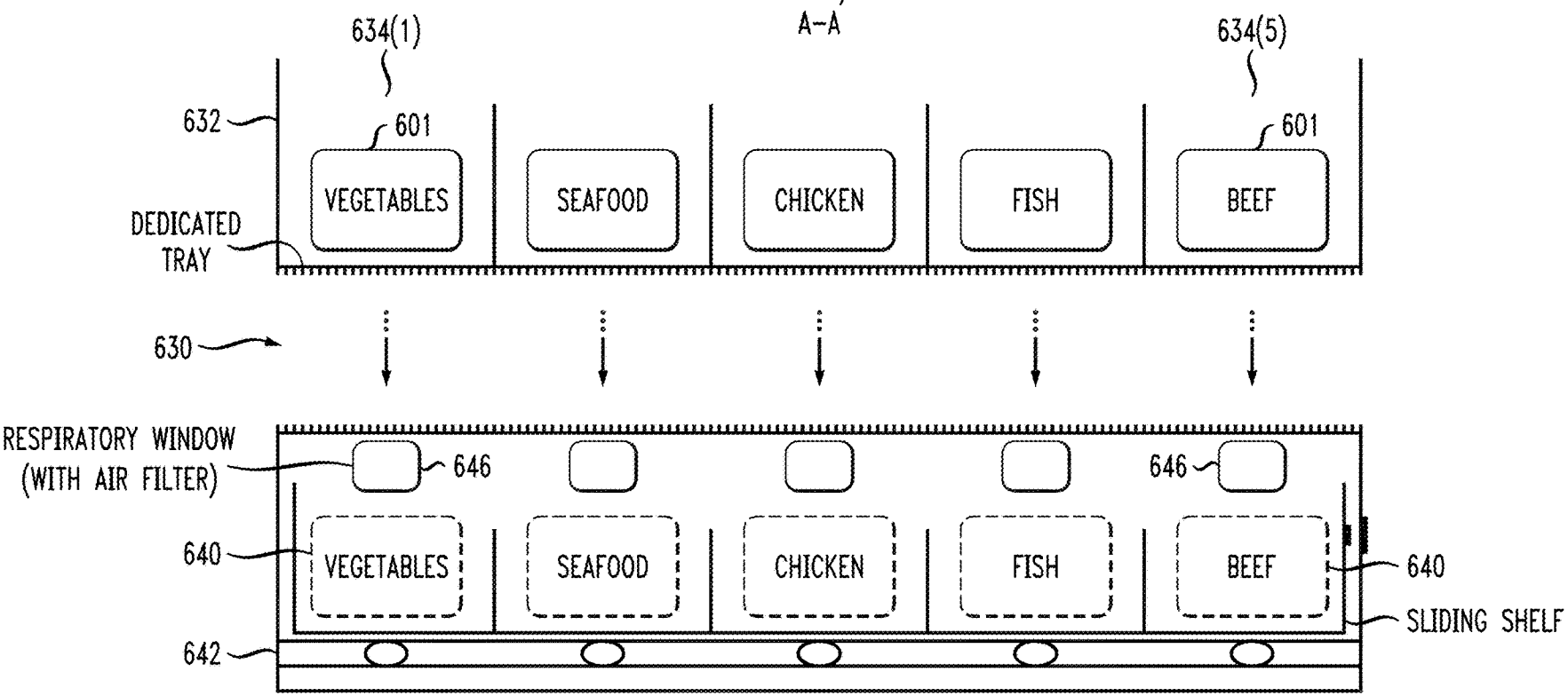
FIG. 6B shows a schematic side X-ray view of a portion of the smart appliance of FIG. 6A.

FIG. 6A is a schematic front X-ray view of a smart appliance (in this case, a chest freezer) 600 according to certain embodiments of the disclosure, while FIG. 6B shows a schematic side X-ray view of a portion of the smart appliance 600 of FIG. 6A.

As shown in FIG. 6A, the smart appliance 600 has a (conventional) freezer section 620 for storing frozen items 601 and a remotely controllable freezing/defrosting section 630 for storing frozen items 601 to be selectively defrosted. As shown in FIG. 6B, the freezing/defrosting section 630 has an upper, freezing shelf 632 with five trays 634(1)-634(5) for storing five different frozen items 601. As represented in FIG. 6A, each tray 634 has its own remotely controllable trap door 636 that, when opened, allows the corresponding frozen item 601 to fall onto a corresponding tray 642 of a defrosting space 640 having a spring-loaded magnetic door 644 that opens under the weight of the frozen item 601 and then closes automatically due to the spring loading. As shown in FIG. 6B, each defrosting space 640 has a respiratory window 646 that allows ambient air and/or warmed air from the smart appliance's cooling system to flow into the defrosting space 640 to thaw the corresponding frozen item 601.

Figure 7A:
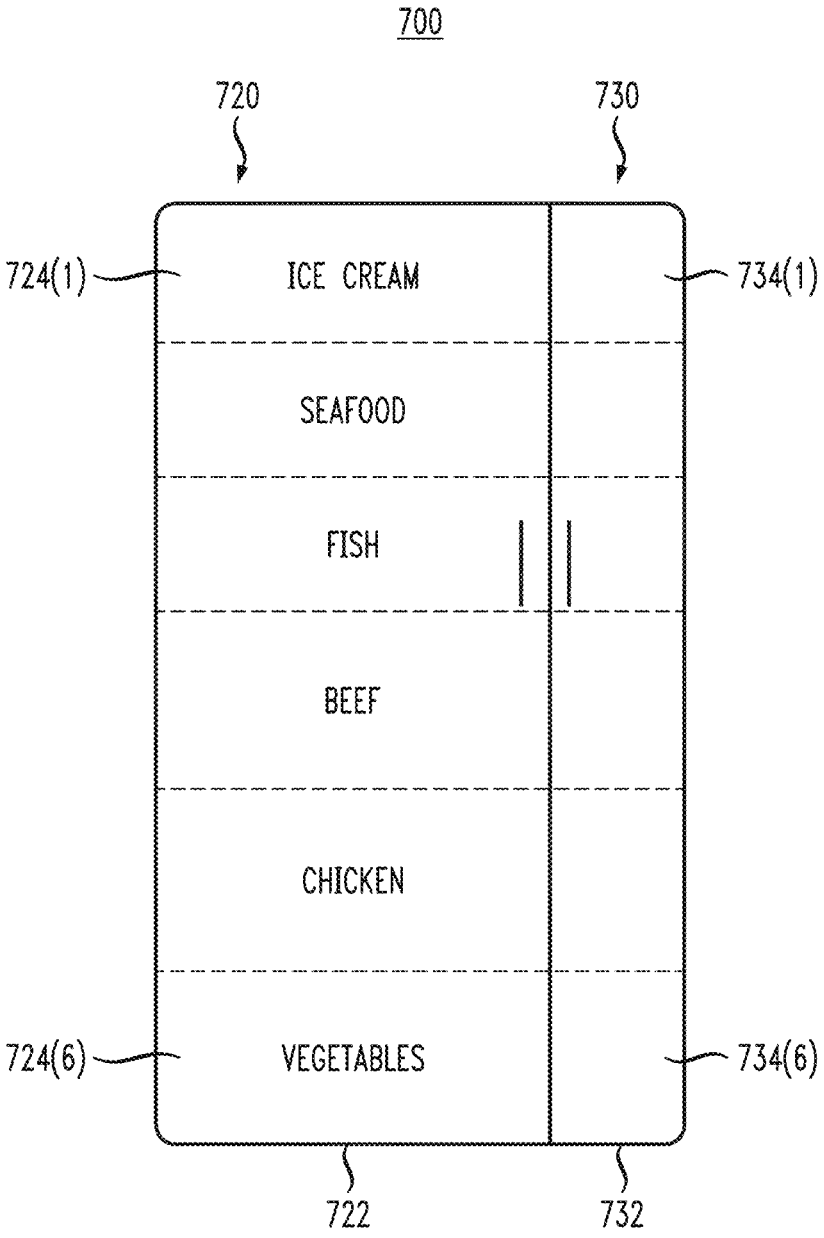
Figure 7B:
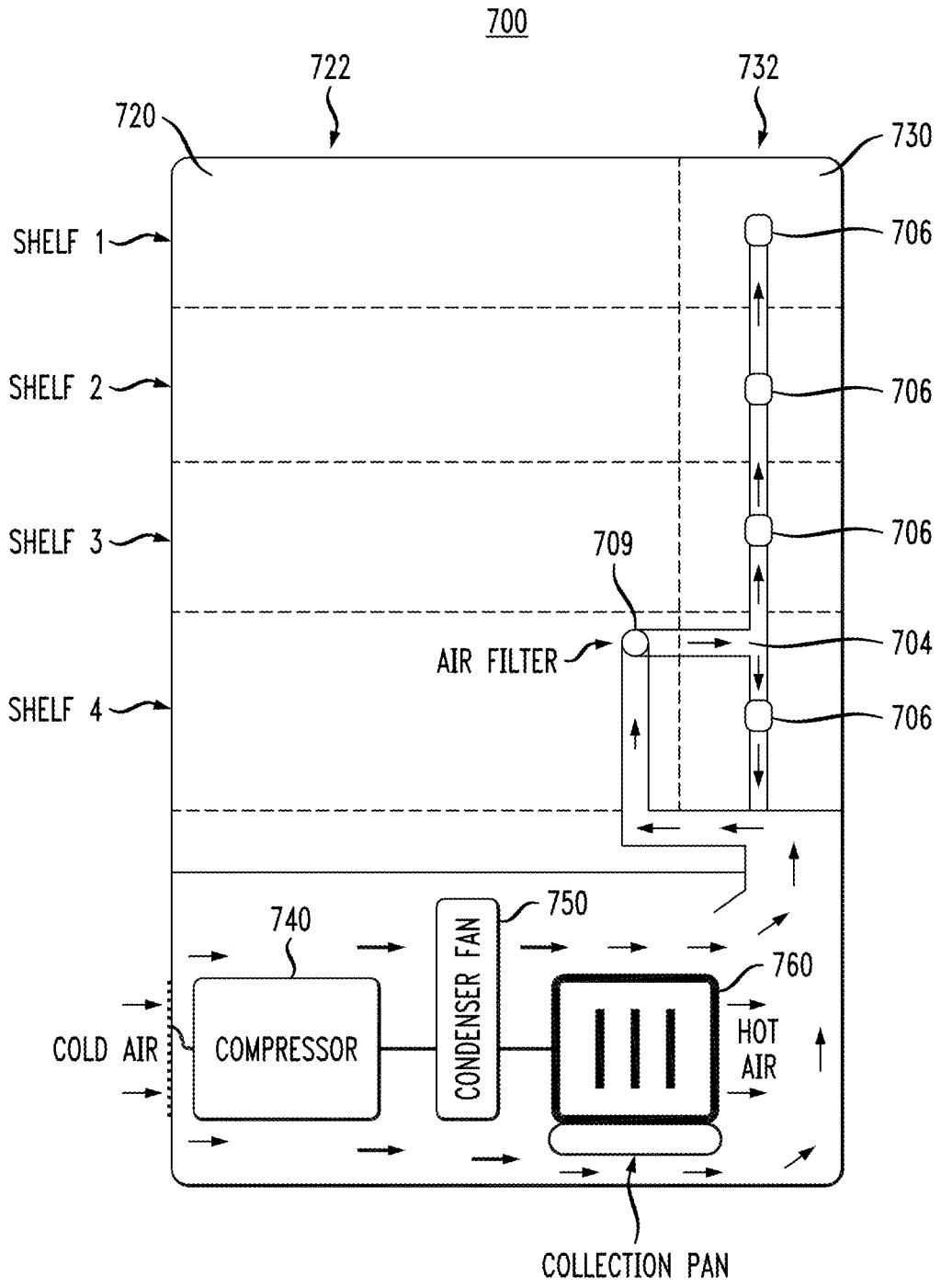
Figure 7C:
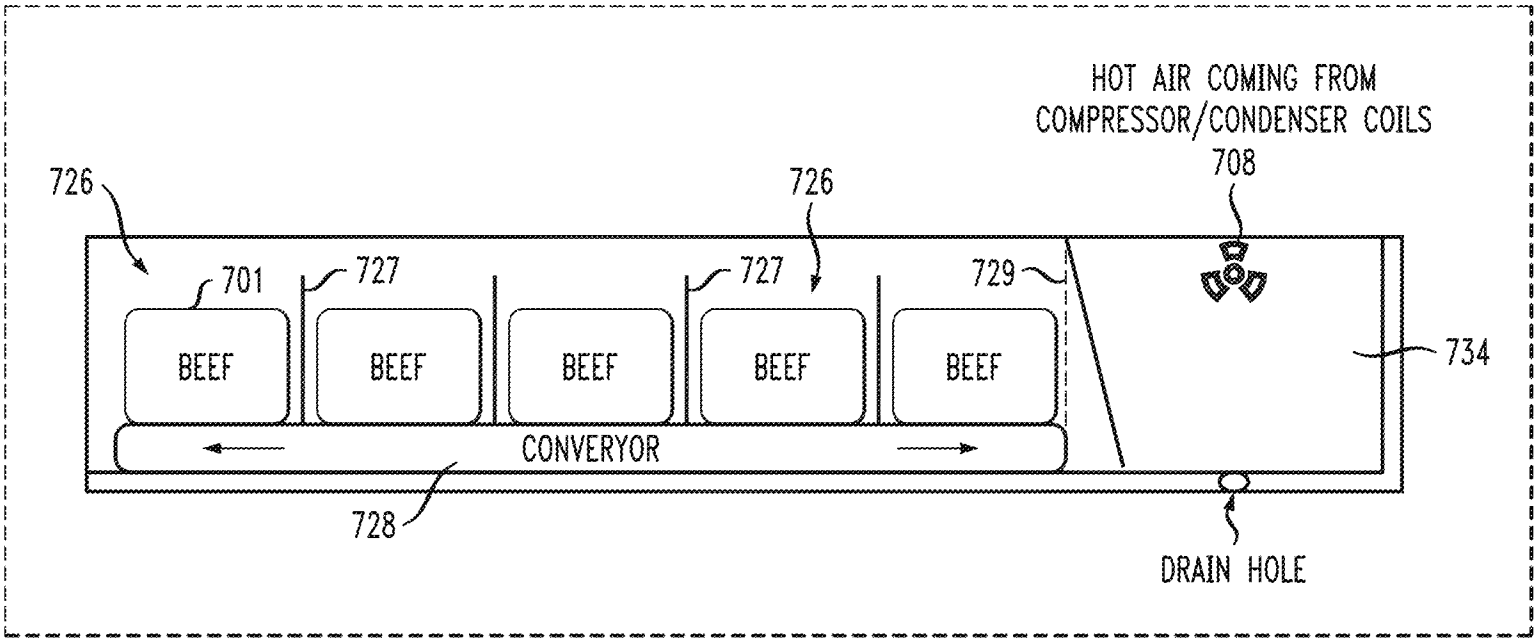
FIG. 7C shows a schematic front X-ray view of a portion of the smart appliance of FIGS. 7A and 7B.

FIGS. 7A and 7B respectively show schematic front and back X-ray views of a smart appliance (in this case, an upright freezer) 700 according to certain embodiments of the disclosure, while FIG. 7C shows a schematic front X-ray view of a portion of the smart appliance 700 of FIGS. 7A and 7B.

As shown in FIG. 7A, the smart appliance 700 has (i) a freezer section 720 having a freezer door 722 and six shelves 724(1)-724(6) and (ii) a defrosting section 730 having a defrosting door 732 and six corresponding shelves 734(1)-734(6).

As shown in FIG. 7B, the smart appliance 700 has a conventional cooling system that includes a compressor 740, a condenser fan 740, and condenser coils 750 that maintains the low temperatures inside the smart appliance's freezer and defrosting sections 720 and 730.

As shown in FIG. 7B, the back of the smart appliance 700 has ductwork 704 with an air filter 709 and remotely controllable valves 706 that enable warmed air from the smart appliance's cooling system to selectively and independently flow into the defrosting spaces associated with the defrosting shelves 734 of the defrosting section 730.

FIG. 7C shows a representation of one of the freezer shelves 724 and the corresponding defrosting shelf 734 of the smart appliance 700. The freezer shelf 724 has five different spaces 726 for frozen items 701 separated by space separators 727 and a remotely controlled underlying conveyor belt 728 that can be remotely controlled to move frozen items 701 one at a time from the freezer shelf 724 through the magnetic door 729 into the corresponding defrosting shelf 734. As shown in FIG. 7C, the defrosting shelf 734 has a (e.g., remotely controllable) fan 708 that helps circulate warm air from the smart appliance's cooling system into the defrosting section to thaw the frozen item 701.

Figure 8:
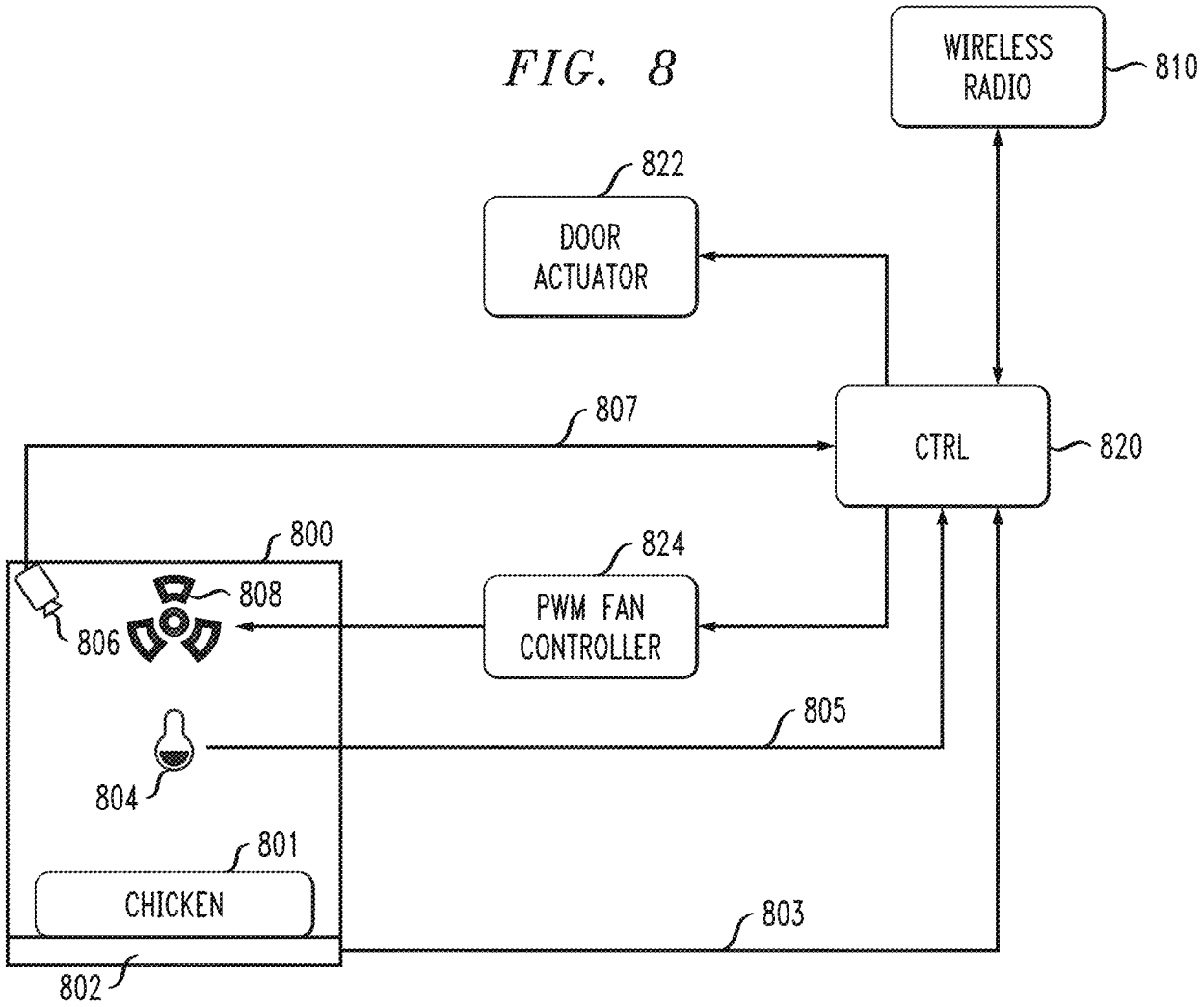
FIG. 8 is a simplified block diagram of electronics, some or all of which may be employed for at least some of the smart appliances shown in FIGS. 1-7 according to certain embodiments of the disclosure.

FIG. 8 is a simplified block diagram of electronics, some or all of which may be employed for at least some of the smart appliances shown in FIGS. 1-7 according to certain embodiments of the disclosure. As shown in FIG. 8, smart appliance 800 has a scale 802, a temperature sensor 804, a camera 806, and a fan 808. The electronics of FIG. 8 also include a wireless radio 810, a smart appliance microcontroller 820, a door actuator 822, and a pulse width modulation (PWM) fan controller 824. As represented in FIG. 8, a frozen item 801 is located on the scale 802 in a defrosting location of the smart appliance 800.

In operation, the microcontroller 820 uses the wireless radio 810 to communicate with the smart appliance app running on the user's mobile device, such as the smartphone 104 of FIG. 1, via appropriate wireless communication infrastructure, such as the WiFi web controller 108 and the home router 112 of FIG. 1, to receive commands from the user, such as to thaw the frozen item 801. The microcontroller 820 receives and uses weight measurements 803 from the scale 802, temperature measurements 805 from the temperature sensor 804, and/or image data 807 from the camera 806 to control (i) the door actuator 822 (for embodiments in which a door (not shown in FIG. 8) is actively opened to allow the frozen item 801 to move to the defrosting location) and/or (ii) the fan 808 via the fan controller 824 (for embodiments in which warmed air from the smart appliance's cooling system (not shown) is actively moved into the defrosting location).

In operation, depending on the particular implementation, the microcontroller 820 performs some of all of the following operations:

- Receive a command from the user to defrost the frozen item 801;
- Control the door actuator 822 to open the corresponding door to allow the frozen item 801 to move to the defrosting location;
- Use weight measurements 803 from the scale 802 and/or image data 807 from the camera 806 to confirm the presence of the frozen item 801 at the defrosting location; and
- Use temperature measurements 805 from the temperature sensor 804 and/or weight measurements 803 from the scale 802 to control the fan 808 via the fan controller 824 to vary the amount of warmed air moved into the defrosting location. In general, heavier frozen items will take longer and/or require more warmed air to defrost than lighter frozen items.

Although not shown in FIG. 8, depending on the embodiment, the microcontroller 820 may also control a conveyor belt used to move the frozen item 801, such as conveyor belt 326 of FIG. 3 or conveyor belt 728 of FIG. 7C, and/or valves used to move warmed air to the defrosting location, such as valves 506 of FIG. 5B or valves 706 of FIG. 7B.

Figure 9:
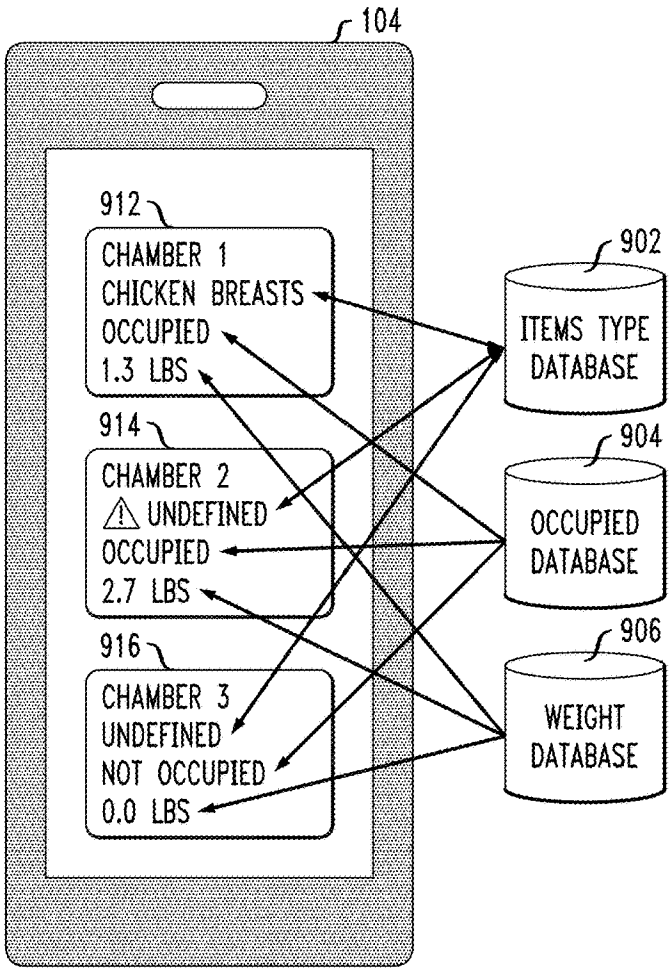
FIG. 9 represents some of the information that may be stored on the user's mobile device or in the cloud for the smart appliance app.

FIG. 9 represents some of the information that may be stored on the user's mobile device, such as the smartphone 104 of FIG. 1, or in the cloud, such as in the web controller 108 of FIG. 1, for the smart appliance app. FIG. 9 shows three different databases 902-906 and three different representations 912-916 of the contents at three different locations (i.e., chambers) in the smart appliance. As shown in FIG. 9, an item type database 902 identifies the different types of frozen items that are currently stored in the chambers, an occupied database 904 identifies whether the chambers contain any frozen items, and a weight database 906 identifies the weights of the frozen items in the chambers. Note that, in some implementations, the item type database 902 is populated manually by the user, while the occupied database 904 and the weight database 906 are populated automatically based on measurements made by the smart appliance's sensors, such as scale 802 and/or camera 806 of FIG. 8.

Figure 10A:
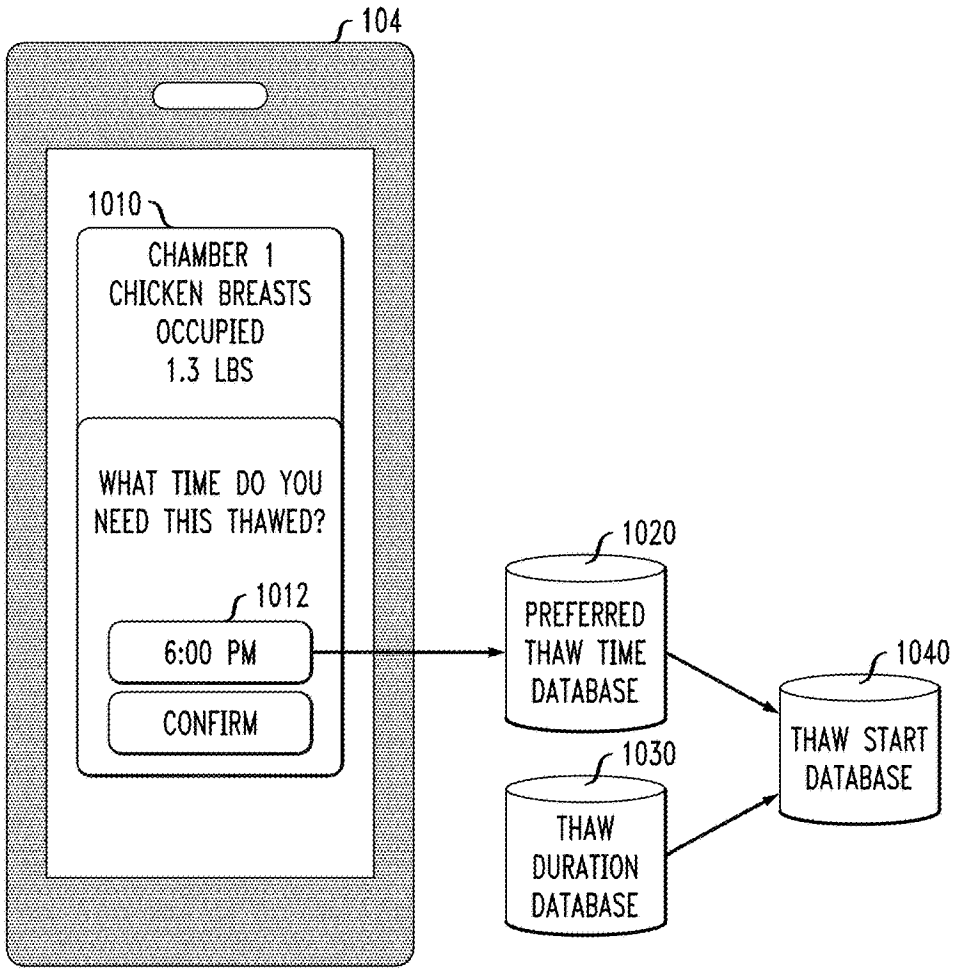
FIGS. 10A-10C represent processing involved in scheduling the thawing of a particular frozen item stored in a smart appliance of the disclosure according to certain implementations of the smart appliance app running on a user's mobile device.
Figure 10C:
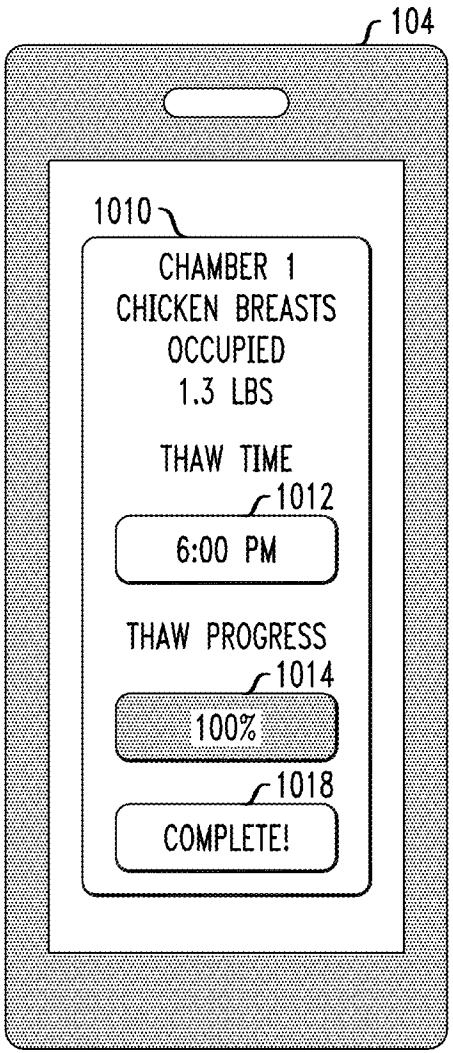
Figure 10B:
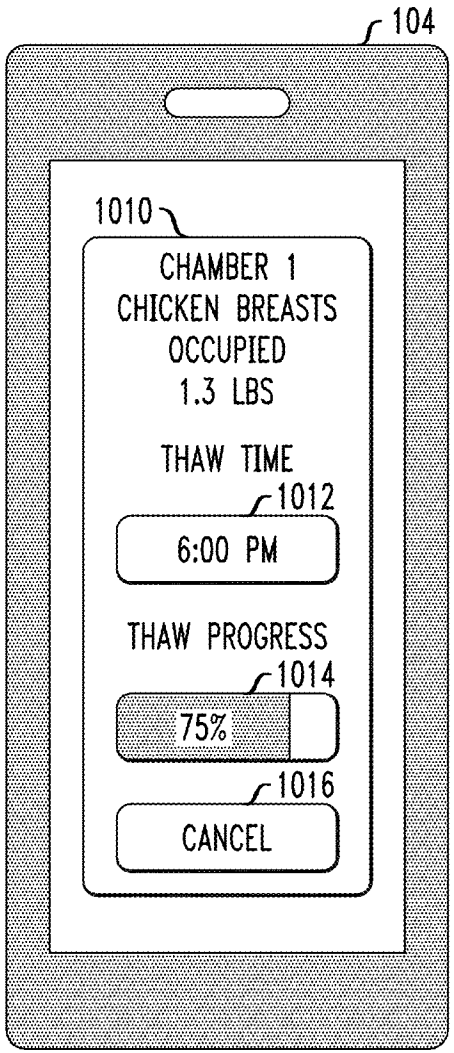

FIGS. 10A-10C represent processing involved in scheduling the thawing of a particular frozen item stored in a smart appliance of the disclosure according to certain implementations of the smart appliance app running on a user's mobile device, such as the smartphone 104 of FIG. 1. FIG. 10A represents the scheduling of a defrosting session, FIG. 10B represents a particular state during the defrosting session, and FIG. 10C represents the completion of the defrosting session.

As represented in FIG. 10A, the user uses a suitable graphical user interface (GUI) 1010 generated by the smart appliance app and displayed on the user's smartphone 104 to select (i) a particular frozen item that is currently stored in the smart appliance, in this case, a package of frozen chicken breasts weighing 1.3 pounds represented in the GUI 1010 as frozen item 912 stored in Chamber 1 of the smart appliance, and (ii) a thaw time 1012 at which the selected frozen item should be defrosted, e.g., 6 pm today. Based on (1) the specified thaw time stored in a thaw time database 1020 (on the smartphone 104 or on the web controller 108) and (2) the thaw duration stored in a thaw duration database 1030 (on the smartphone 104 or on the web controller 108), the smart appliance app determines and stores the thaw start time in a thaw start database 1040 (on the smartphone 104 or on the web controller 108). Note that the thaw duration may be a function of the weight of the frozen item. At the thaw start time, the smart appliance app will communicate with the microcontroller 820 of FIG. 8 to begin the defrosting session.

In some implementations, a standard defrosting session occurs at a defrosting temperature below the FDA-recommended limit of 39° F., such as at 37° F.+/−1° F. The smart appliance app might also support a turbo thaw mode that enables an accelerated defrosting session to occur at a temperature higher than the standard defrosting temperature up to the maximum temperature possible from air warmed by the smart appliance's cooling system.

As represented in FIG. 10B, the smart appliance app's GUI 1010 displays (i) the selected thaw time and (ii) an indication 1014 of the state of the defrosting session, i.e., in this case, 75% completed. In some implementations, the state of the defrosting session may be generated by the smart appliance app based solely on time. In other implementations, the smart appliance app might also take into account temperature measurements from a temperature sensor, such as temperature sensor 804 of FIG. 8. The GUI 1010 also enables the user to cancel (1016) the defrosting session, which would require the user to remove the item from the defrosting location.

When the specified thaw time 1012 is reached, in some implementations, the smart appliance app determines that the defrosting session has been completed. In other implementations, the smart appliance app compares the weight of the frozen item at the beginning of the defrosting session to the weight of the frozen item at the specified thaw time to determine whether the item has been sufficiently thawed. For some frozen items, sufficient thawing is detected when the item's weight drops by a specified amount, e.g., a programmable value equal to or below 6%. If the specified weight drop has not been reached, then the defrosting session may be automatically extended.

In any case, as represented in FIG. 10C, when the defrosting session is determined to be completed, the smart appliance app generates the GUI 1010 to include a 100% indication 1014 and a session-completion message 1018. In some implementations, the current temperature at the defrosting location is maintained until the thawed item is removed from the smart appliance. Until the thawed item is removed from the defrosting location, no other frozen items may be thawed at that defrosting location until the previous item has been removed.

As described or suggested above, in certain embodiments, the smart appliance app running on the user's smartphone 104 and/or the cloud-based web controller 108 and/or the smart appliance's microcontroller 820 of FIG. 8 can perform some or all of the following functions:

- Determine whether defrosting locations are occupied by frozen items based on measurements from smart appliance sensors;
- Calculate thaw durations for frozen items based on weight measurements from scales;
- Populate occupied and weight databases 904 and 906 of FIG. 9 based on measurements from smart appliance sensors;
- Control doors and/or conveyor belts to move frozen items to defrosting locations;
- Control airflow into defrosting locations; and
- Determine whether an item has been sufficiently thawed based on weight measurements from scales and/or temperature measurements from temperature sensors.

Embodiments have been described in which warmed air is forced or at least allowed to enter the appliance's defrosting space. In some implementations, the appliance may have a passive or active vent, e.g., near the bottom of the defrosting space, that allows air to be exhausted from the defrosting space and from the appliance. An active vent may be an electronically controllable device that can regulate the amount of air leaving the defrosting space based on the rate at which warmed air is supplied to the defrosting space, e.g., based on the speed of the fan.

In some embodiments, the warmed air from the appliance's cooling system may be used to heat a coil that is routed around the walls and/or floor of the defrosting space to further distribute heat to the defrosting space.

In certain embodiments, the present disclosure is a smart appliance comprising a wireless radio adapted to receive a defrosting command from a remote wireless controller; a local controller adapted to receive the defrosting command from the wireless radio; and a freezer section adapted to store a frozen item, wherein, upon receipt of the defrosting command, the local controller is adapted to control the freezer section to thaw the frozen item.

In at least some of the above embodiments, the smart appliance further comprises a defrosting section, wherein, upon receipt of the defrosting command, the local controller is adapted to control the smart appliance to move the frozen item from the freezer section into the defrosting section.

In at least some of the above embodiments, the freezer section has a controllable door and an angled ramp adapted to support the frozen item and, upon receipt of the defrosting command, the local controller is adapted to open the controllable door to allow the frozen item to slide off the angled ramp into the defrosting section.

In at least some of the above embodiments, the freezer section has a controllable conveyor belt adapted to support the frozen item and, upon receipt of the defrosting command, the local controller is adapted to control the controllable conveyor belt to move the frozen item from the freezer section into the defrosting section.

In at least some of the above embodiments, the defrosting section has a respiratory window that allows external air to flow into the defrosting section.

In at least some of the above embodiments, the smart appliance further comprises a cooling system and ductwork adapted to move the external air warmed by the cooling system into the defrosting section.

In at least some of the above embodiments, the freezer section has a freezing tray located above the defrosting section and adapted to store the frozen item; the freezing tray has a controllable trap door; and, upon receipt of the defrosting command, the local controller is adapted to open the controllable trap door to allow the frozen item to drop from the freezing tray into the defrosting section.

In at least some of the above embodiments, the freezer section has a plurality of freezing trays located above the defrosting section and adapted to store a plurality of frozen items; each freezing tray has a corresponding controllable trap door; upon receipt of the defrosting command, the local controller is adapted to open a first of the controllable trap doors to allow a corresponding first frozen item to drop from the corresponding freezing tray into the defrosting section; and, upon receipt of a different defrosting command, the local controller is adapted to open a second of the controllable trap doors to allow a corresponding second frozen item to drop from the corresponding freezing tray into the defrosting section.

In at least some of the above embodiments, the freezer section has a combined freezing/defrosting space adapted to store the frozen item and, upon receipt of the defrosting command, the local controller is adapted to control the combined freezing/defrosting space to thaw the frozen item.

In at least some of the above embodiments, the smart appliance further comprises a cooling system and ductwork adapted to move air warmed by the cooling system into the combined freezing/defrosting space.

In at least some of the above embodiments, the freezer section has a plurality of combined freezing/defrosting spaces adapted to store a plurality of frozen items; upon receipt of the defrosting command, the local controller is adapted to control a first of the combined freezing/defrosting spaces to thaw a corresponding first frozen item; and, upon receipt of a different defrosting command, the local controller is adapted to control a second of the combined freezing/defrosting spaces to thaw a corresponding second frozen item.

In at least some of the above embodiments, the smart appliance further comprises a cooling system and ductwork having independently controllable valves adapted to selectively move air warmed by the cooling system into different ones of the combined freezing/defrosting spaces.

Unless explicitly stated otherwise, each numerical value and range should be interpreted as being approximate as if the word "about" or "approximately" preceded the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence. Likewise, additional steps may be included in such methods, and certain steps may be omitted or combined, in methods consistent with various embodiments of the disclosure.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation. " Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

Also, for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required.

Conversely, the terms "directly coupled," "directly connected," etc., imply the absence of such additional elements. The same type of distinction applies to the use of terms "attached" and "directly attached," as applied to a description of a physical structure.

As used herein in reference to an element and a standard, the terms "compatible" and "conform" mean that the element communicates with other elements in a manner wholly or partially specified by the standard and would be recognized by other elements as sufficiently capable of communicating with the other elements in the manner specified by the standard. A compatible or conforming element does not need to operate internally in a manner specified by the standard.

The described embodiments are to be considered in all respects as only illustrative and not restrictive. In particular, the scope of the disclosure is indicated by the appended claims rather than by the description and figures herein. All changes that come within the meaning and range of equivalency of the claims are to be embraced within their scope.

The functions of the various elements shown in the figures, including any functional blocks labeled as "processors" and/or "controllers," may be provided through the use of dedicated hardware as well as hardware capable of executing software in association with appropriate software. Upon being provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those of ordinary skill in the art that any block diagrams herein represent conceptual views of illustrative circuitry embodying the principles of the disclosure. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

As will be appreciated by one of ordinary skill in the art, the present disclosure may be embodied as an apparatus (including, for example, a system, a network, a machine, a device, a computer program product, and/or the like), as a method (including, for example, a business process, a computer-implemented process, and/or the like), or as any combination of the foregoing. Accordingly, embodiments of the present disclosure may take the form of an entirely software-based embodiment (including firmware, resident software, micro-code, and the like), an entirely hardware embodiment, or an embodiment combining software and hardware aspects that may generally be referred to herein as a "system" or "network".

Embodiments of the disclosure can be manifest in the form of methods and apparatuses for practicing those methods. Embodiments of the disclosure can also be manifest in the form of program code embodied in tangible media, such as magnetic recording media, optical recording media, solid state memory, floppy diskettes, CD-ROMs, hard drives, or any other non-transitory machine-readable storage medium, wherein, upon the program code being loaded into and executed by a machine, such as a computer, the machine becomes an apparatus for practicing the disclosure. Embodiments of the disclosure can also be manifest in the form of program code, for example, stored in a non-transitory machine-readable storage medium including being loaded into and/or executed by a machine, wherein, upon the program code being loaded into and executed by a machine, such as a computer, the machine becomes an apparatus for practicing the disclosure. Upon being implemented on a general-purpose processor, the program code segments combine with the processor to provide a unique device that operates analogously to specific logic circuits. The term "non-transitory," as used herein, is a limitation of the medium itself (i.e., tangible, not a signal) as opposed to a limitation on data storage persistency (e.g., RAM vs. ROM).

Signals and corresponding terminals, nodes, ports, links, interfaces, or paths may be referred to by the same name and/or label and are interchangeable for purposes here.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

As used herein, "at least one of the following: <a list of two or more elements>" and "at least one of <a list of two or more elements>" and similar wording, where the list of two or more elements are joined by "and" or "or", mean at least any one of the elements, or at least any two or more of the elements, or at least all the elements. For example, the phrases "at least one of A and B" and "at least one of A or B" are both to be interpreted to have the same meaning, encompassing the following three possibilities: 1—only A; 2—only B; 3—both A and B.

All documents mentioned herein are hereby incorporated by reference in their entirety or alternatively to provide the disclosure for which they were specifically relied upon.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

As used herein and in the claims, the term "provide" with respect to an apparatus or with respect to a system, device, or component encompasses designing or fabricating the apparatus, system, device, or component; causing the apparatus, system, device, or component to be designed or fabricated; and/or obtaining the apparatus, system, device, or component by purchase, lease, rental, or other contractual arrangement.

While preferred embodiments of the disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the technology of the disclosure. It is intended that the following claims define the scope of the invention and that methods and structures within the scope of these claims and their equivalents be covered thereby.

What is claimed is:

1. A smart appliance comprising:

a wireless radio adapted to receive a defrosting command from a remote wireless controller;

a local controller adapted to receive the defrosting command from the wireless radio;

a freezer section adapted to store a frozen item, wherein, upon receipt of the defrosting command, the local controller is adapted to control the freezer section to thaw the frozen item; and a defrosting section, wherein, upon receipt of the defrosting command, the local controller is adapted to control the smart appliance to move the frozen item from the freezer section into the defrosting section.

2. The smart appliance of claim 1, wherein:

the freezer section has a controllable door and an angled ramp adapted to support the frozen item; and upon receipt of the defrosting command, the local controller is adapted to open the controllable door to allow the frozen item to slide off the angled ramp into the defrosting section.

3. The smart appliance of claim 1, wherein:

the freezer section has a controllable conveyor belt adapted to support the frozen item; and upon receipt of the defrosting command, the local controller is adapted to control the controllable conveyor belt to move the frozen item from the freezer section into the defrosting section.

4. The smart appliance of claim 1, wherein the defrosting section has a respiratory window that allows external air to flow into the defrosting section.

5. The smart appliance of claim 4, further comprising:

a cooling system; and ductwork adapted to move the external air warmed by the cooling system into the defrosting section.

6. The smart appliance of claim 1, wherein:

the freezer section has a freezing tray located above the defrosting section and adapted to store the frozen item;

the freezing tray has a controllable trap door; and upon receipt of the defrosting command, the local controller is adapted to open the controllable trap door to allow the frozen item to drop from the freezing tray into the defrosting section.

7. The smart appliance of claim 6, wherein:

the freezer section has a plurality of freezing trays located above the defrosting section and adapted to store a plurality of frozen items;

each freezing tray has a corresponding controllable trap door;

upon receipt of the defrosting command, the local controller is adapted to open a first of the controllable trap doors to allow a corresponding first frozen item to drop from the corresponding freezing tray into the defrosting section; and upon receipt of a different defrosting command, the local controller is adapted to open a second of the controllable trap doors to allow a corresponding second frozen item to drop from the corresponding freezing tray into the defrosting section.

8. The smart appliance of claim 1, wherein:

the freezer section has a combined freezing/defrosting space adapted to store the frozen item; and upon receipt of the defrosting command, the local controller is adapted to control the combined freezing/defrosting space to thaw the frozen item.

9. The smart appliance of claim 8, further comprising:

a cooling system; and ductwork adapted to move air warmed by the cooling system into the combined freezing/defrosting space.

10. The smart appliance of claim 8, wherein:

the freezer section has a plurality of combined freezing/defrosting spaces adapted to store a plurality of frozen items;

upon receipt of the defrosting command, the local controller is adapted to control a first of the combined freezing/defrosting spaces to thaw a corresponding first frozen item; and upon receipt of a different defrosting command, the local controller is adapted to control a second of the combined freezing/defrosting spaces to thaw a corresponding second frozen item.

11. The smart appliance of claim 10, further comprising:

a cooling system; and ductwork having independently controllable valves adapted to selectively move air warmed by the cooling system into different ones of the combined freezing/defrosting spaces.

12. A method for thawing a frozen item using a smart appliance, the method comprising:

a wireless radio of the smart appliance receiving a defrosting command from a remote wireless controller;

a local controller of the smart appliance receiving the defrosting command from the wireless radio;

a freezer section of the smart appliance storing the frozen item, wherein, upon receipt of the defrosting command, the local controller controls the freezer section to thaw the frozen item; and upon receipt of the defrosting command, the local controller controlling the smart appliance to move the frozen item from the freezer section into a defrosting section of the smart appliance.

13. The method of claim 12, wherein:

the freezer section has a controllable door and an angled ramp that supports the frozen item; and upon receipt of the defrosting command, the local controller opens the controllable door to allow the frozen item to slide off the angled ramp into the defrosting section.

14. The method of claim 12, wherein:

the freezer section has a controllable conveyor belt that supports the frozen item; and upon receipt of the defrosting command, the local controller controls the controllable conveyor belt to move the frozen item from the freezer section into the defrosting section.

15. The method of claim 12, further comprising ductwork of the smart appliance moving external air warmed by a cooling system of the smart appliance into the defrosting section.

16. The method of claim 12, wherein, upon receipt of the defrosting command, the local controller open a controllable trap door of the smart appliance to allow the frozen item to drop from a freezing tray of the smart appliance into the defrosting section.

17. The method of claim 12, wherein, upon receipt of the defrosting command, the local controller is adapted to control a combined freezing/defrosting space of the smart appliance to thaw the frozen item.

18. The method of claim 17, further comprising controlling independently controllable valves to selectively move air warmed by a cooling system of the smart appliance through ductwork of the smart appliance into different ones of combined freezing/defrosting spaces of the smart appliance.

19. A smart appliance comprising:

a wireless radio adapted to receive a defrosting command from a remote wireless controller;

a local controller adapted to receive the defrosting command from the wireless radio;

a combined freezing/defrosting section adapted to store a frozen item;

a cooling system adapted to cool the combined freezing/defrosting section during normal operations, wherein, during the normal operations, the cooling system removes heat from the smart appliance as part of the process of cooling the combined freezing/defrosting section; and controllable ductwork controlled by the local controller to move air warmed by the cooling system into the combined freezing/defrosting space to thaw the frozen item upon receipt of the defrosting command by the local controller.

20. The smart appliance of claim 19, wherein:

the freezer section has a plurality of combined freezing/defrosting spaces adapted to store a plurality of frozen items;

upon receipt of the defrosting command, the local controller is adapted to control a first of the combined freezing/defrosting spaces to thaw a corresponding first frozen item;

upon receipt of a different defrosting command, the local controller is adapted to control a second of the combined freezing/defrosting spaces to thaw a corresponding second frozen item; and the controllable ductwork comprises independently controllable valves controlled by the local controller to selectively move air warmed by the cooling system into different ones of the combined freezing/defrosting spaces.

* * * * *